US008734109B2

(12) United States Patent
He et al.

(10) Patent No.: US 8,734,109 B2
(45) Date of Patent: May 27, 2014

(54) FOLDABLE ELECTRIC FAN

(75) Inventors: Xiangming He, Jiangmen (CN); Guanglian Lin, Jiangmen (CN)

(73) Assignee: Jiangmen Keye Electrical & Mechanical Manufacturing Co., Ltd. (CN)

( * ) Notice: Subject to any disclaimer, the term of this patent is extended or adjusted under 35 U.S.C. 154(b) by 368 days.

(21) Appl. No.: 13/245,152

(22) Filed: Sep. 26, 2011

(65) Prior Publication Data

US 2013/0004330 A1 Jan. 3, 2013

(30) Foreign Application Priority Data

Jun. 28, 2011 (CN) ..... 2011 2 0222227 U

(51) Int. Cl.
*B63H 5/125* (2006.01)
*B63H 3/00* (2006.01)
*B63H 7/00* (2006.01)

(52) U.S. Cl.
USPC ..... 416/142; 416/205; 416/246

(58) Field of Classification Search
USPC ..... 416/246, 244 R, 248, 204 R, 205, 142; 248/529, 188.7
See application file for complete search history.

(56) References Cited

U.S. PATENT DOCUMENTS

| | | | | |
|---|---|---|---|---|
| 5,411,373 | A * | 5/1995 | Chiu et al. | 416/246 |
| 6,183,204 | B1 | 2/2001 | Chang | |
| 6,293,755 | B1 * | 9/2001 | Fu | 416/244 R |
| 6,932,579 | B2 * | 8/2005 | Cichetti et al. | 416/246 |
| 7,874,798 | B2 * | 1/2011 | Frampton et al. | 416/5 |
| 2003/0059307 | A1 * | 3/2003 | Moreno et al. | 416/142 |

FOREIGN PATENT DOCUMENTS

| | | |
|---|---|---|
| CN | 2903499 | 5/2007 |
| CN | 201250785 | 6/2009 |

* cited by examiner

*Primary Examiner* — Edward Look
*Assistant Examiner* — Christopher J Hargitt
(74) *Attorney, Agent, or Firm* — Schmeiser, Olsen & Watts, LLP

(57) ABSTRACT

A foldable electric fan, comprising: a fan head, a support tube and a base, a turnover mechanism for turning the fan head up or down is provided between the top of the support tube and the fan head, is disclosed. Further, the base is foldable, and the electric fan can be arranged into a desk fan or a floor fan by turning the fan head up or down, and can be used for several different purposes in more broad fields. The fan head and the base of the electric fan can be folded-up, which reduces the space it occupies and cuts down the cost of package and transportation. Moreover, the foldable electric fan effectively reduces the inconvenience of traditional electric fans which need to be detached into several parts during package and transportation, and then assembled together for use.

6 Claims, 17 Drawing Sheets

FOLDABLE ELECTRIC FAN

FIELD OF TECHNOLOGY

The following relates to electric fans, and more particularly relates to a foldable electric fan.

BACKGROUND

A regular floor fan, as shown in FIG. 1, generally comprises a fan head 1', a support shank 2' and a base 3', which sequentially connected with each other. The support shank 2' is retractable, so the upright height of the fan head 1' is adjustable by raising the support shank 2' up or drawing it down. However, the adjustable range of height of the fan head 1' is restricted, because the retractable length of the support shank 2' is limited, such an electric fan can be arranged into a floor fan only, and can not be arranged into a desk fan. Moreover, the fan head 1', the support shank 2' and the base 3' need to be detached during package and transportation, and the user has to reassemble them together before using. The process of detachment is time-consuming, and the operation is complicated. A risk of losing some tiny parts may also exist. Further, influenced by the size of the base which is usually a regular disc-like base and the length of the support shank, the electric fan after detachment also occupies a large space even if it can be detached into several parts and packed up separately. Thus, the cost of package and transportation is greatly increased.

SUMMARY

In view of the problems and drawbacks, an object of the present invention is to provide a foldable electric fan which can be arranged into a floor fan or a desk fan by turning the fan head up or down. Moreover, the fan head and the base of this fan can be folded-up, which greatly reduce the space it occupies and cut down the cost of package and transportation. Moreover, the present invention effectively avoid the inconvenience of traditional electric fans which need to be detached into several parts during package and transportation, and then the parts need to be assembled together for use. It also reduces the process of packing, saves time and energy, with high practicability.

To achieve the above object, the present invention employs the following technical solution:

A foldable electric fan, comprising a fan head, a support tube and a base, a turnover mechanism is provided between the top of the support tube and the fan head for turning the fan head up or down.

The support tube comprises two erect tubes and two height-adjusting tubes which engaging with the two erect tubes respectively. The turnover mechanism is connected between the top of the two height-adjusting tubes and the fan head.

The turnover mechanism according to the invention comprises a connecting block connected on the top of the two height-adjusting tubes, and a fan head joining tube connected on the middle part of the top of the connecting block. Two axes are respectively provided on both sides of the connecting block, each axis goes through a hole on the height-adjusting tube and hinge connects with a nut.

As an improvement of the present invention, an automatic position-limit and locking mechanism is arranged on the top of the connecting block and the height-adjusting tube to limit and lock the turnover mechanism for locking the fan head tighter when the electric fan stands upright. As a further improvement of the present invention, the automatic position-limit and locking mechanism is a spring bolt provided on the connecting block, comprising a seat fixed on said connecting block, a rod through a hole on the seat, a compression spring surrounding the rod, and a locating hole on the top of the height-adjusting tube for mating with the rod.

Moreover, the automatic position-limit and locking mechanism may be a pawl ratchet assembly installed between the end of the connecting block and the height-adjusting tube. A pivot on the end of the connecting block sequentially passes through a center hole of the ratchet and a mounting hole on the top of the height-adjusting tube, and then connects with a nut. The pawl engaging with the ratchet is configured between the end of the connecting block and the ratchet. A rotatable handle is fixed joint on the outside surface of the pawl, and a V-shape spring providing the elastic resilience of the pawl is configured between the connecting block and the pawl.

The base according to the present invention has three types as follows:

Firstly, the base comprises a stationary base paralleled with the fan head, a vertical moveable base which can be turned upwardly, and a horizontal moveable base which can be horizontally folded toward a side of the stationary base. The vertical moveable base is articulated with the middle part of the stationary base by a horizontal first door hinge assembly. Further, the horizontal moveable base is also articulated with the stationary base by a vertical second door hinge assembly. Safety bolts are provided on the corresponding place of the stationary base to fasten the vertical moveable base and the horizontal moveable base. The vertical moveable base can be turned upwards and the horizontal moveable base can be folded toward a side of the stationary base while storing the base, then the whole base can be folded-up, which greatly reduces the space it occupied.

Secondly, the base comprises a stationary base paralleled with the fan head, and a rotatable base under the stationary base. The rotatable base can be folded to the stationary base. And the rotatable base is detachable joint with the stationary base by a lock nut, a fastening bolt and a lock screw. The lock nut, the lock screw and the fastening bolt can be loosen, and the rotatable base can be turned and engaged with the lower part of the stationary base while storing the base, this greatly reduces the space it occupied.

Thirdly, the base comprises a stationary base paralleled with the fan head, and a rotatable base under the stationary base. The rotatable base can be folded towards the stationary base. And the rotatable base is detachable joint with the stationary base by a fastening bolt. The fastening bolt can be loosen and the rotatable base can be turned and engaged with the lower part of the stationary base while storing the base, this greatly reduces the space it occupied.

The present invention has the following advantageous effects as compared with the prior art:

(1) The fan head can be turned up or down by the turnover mechanism, so that the electric fan can be arranged into a desk fan or a floor fan , this means that the electric fan can be used for several different purposes in more broad fields;

(2) The fan head can be turned down, which helps to fold-up and store and greatly reduces the space in the height direction it occupied. Furthermore, the base of the electric fan can be folded-up for storing, which efficiently reduces the space the base taken. Thus the electric fan is overall structurally compact, which reducing the space it occupied and cutting down the cost of package and transportation;

(3) The electric fan according to the invention can be packed and transported without detaching and reassembling, which greatly reduces the inconvenience during detachment and reassembly, saves time and energy, with high practicability.

BRIEF DESCRIPTION OF THE DRAWINGS

To make the present invention more clearly comprehensible, preferred embodiments of the present invention will be described with reference to the drawings.

DETAILED DESCRIPTION

Embodiment 1

Figure 1:
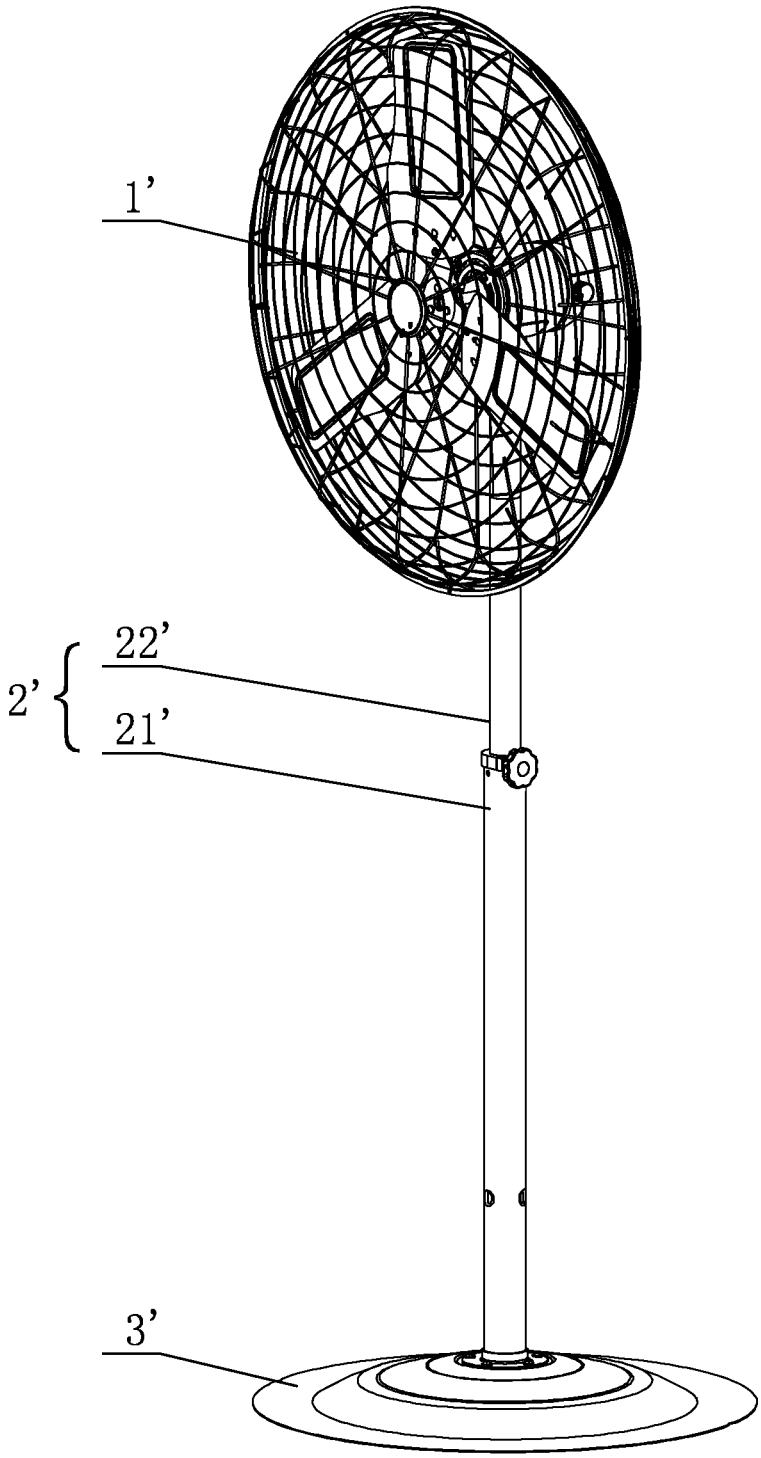
FIG. 1 is a schematic view of a conventional floor fan.
Figure 2:
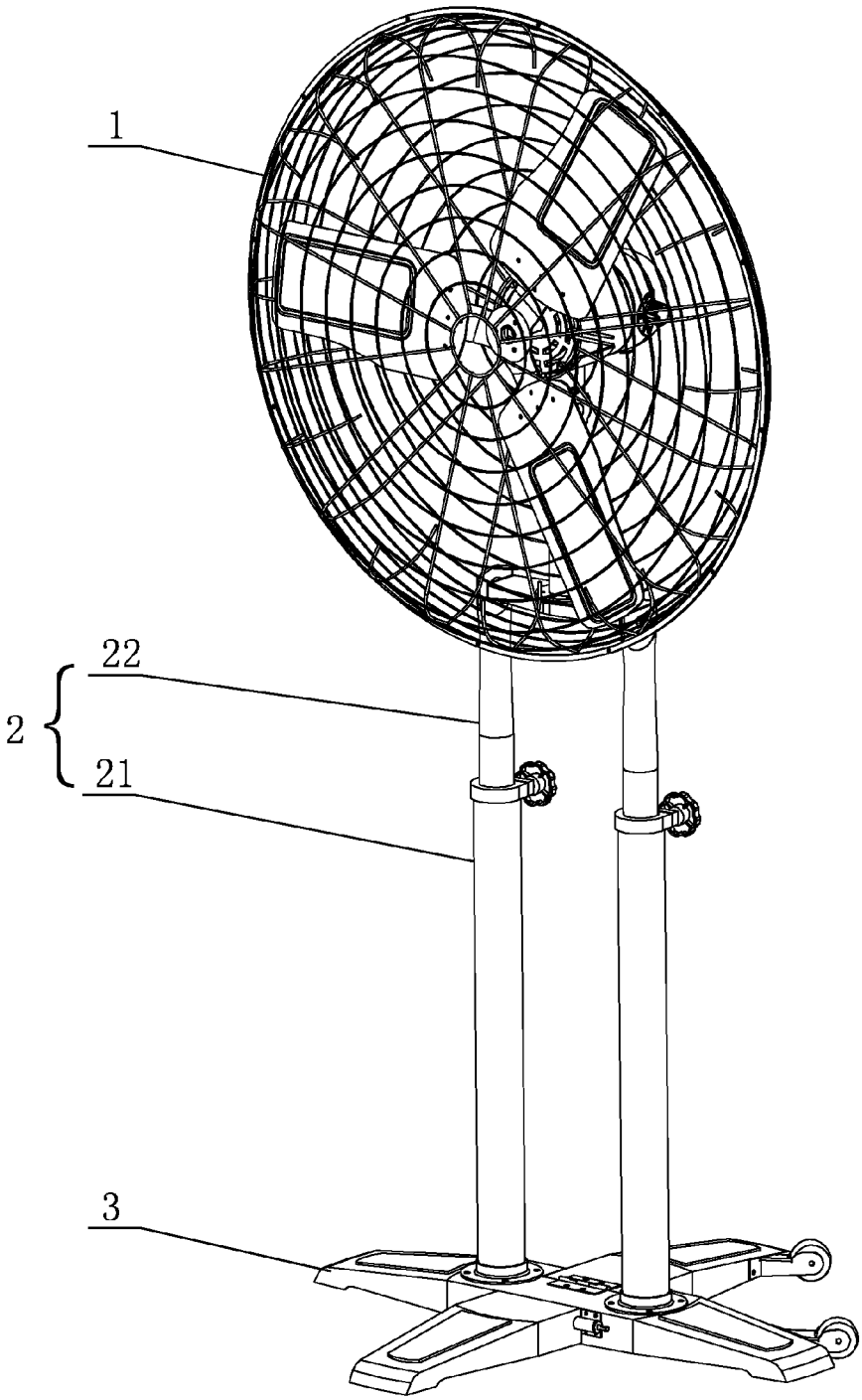
FIG. 2 is a schematic view of a floor fan according to the present invention.
Figure 3:
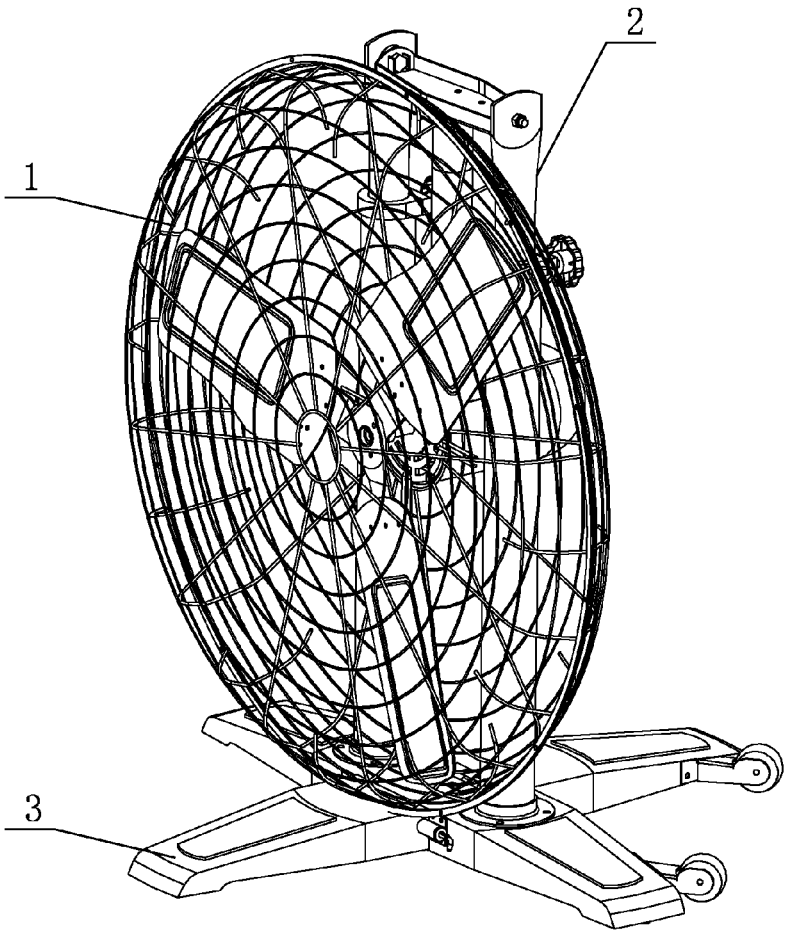
FIG. 3 is a schematic view of a desk fan according to the present invention.
Figure 4:
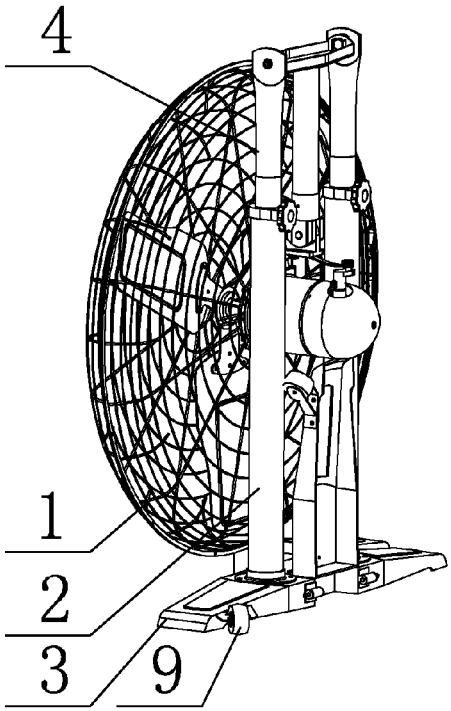
FIG. 4 is a first schematic view of a folded electric fan according to Embodiment 1 of the present invention.
Figure 5:
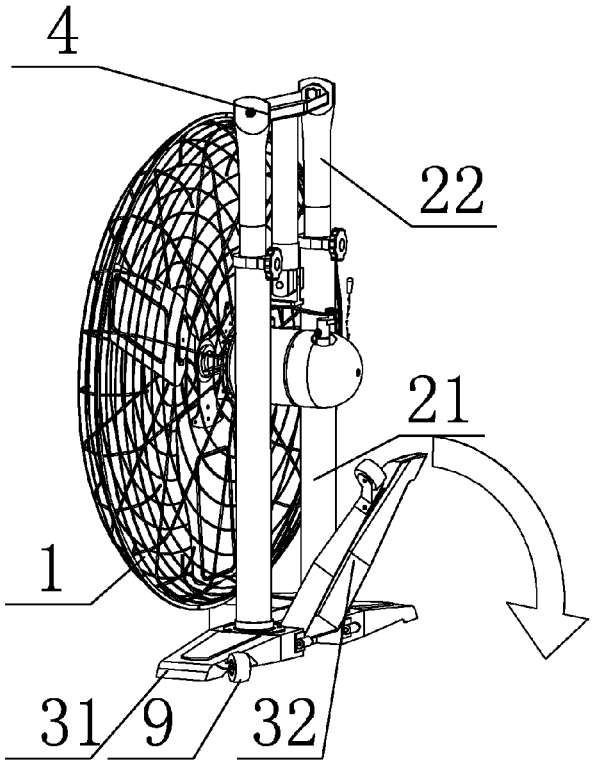
FIG. 5 is a second schematic view of an electric fan with the horizontal moveable base opened according to Embodiment 1 of the present invention.
Figure 6:
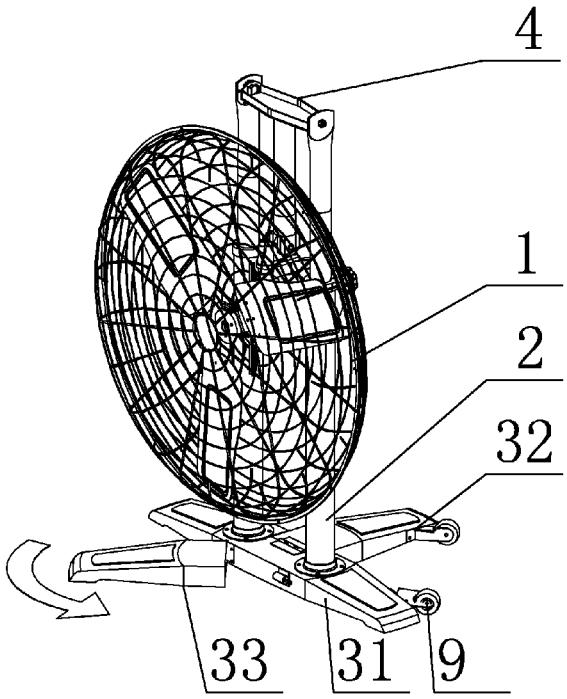
FIG. 6 is a third schematic view of an electric fan with the vertical moveable base opened according to Embodiment 1 of the present invention.
Figure 7:
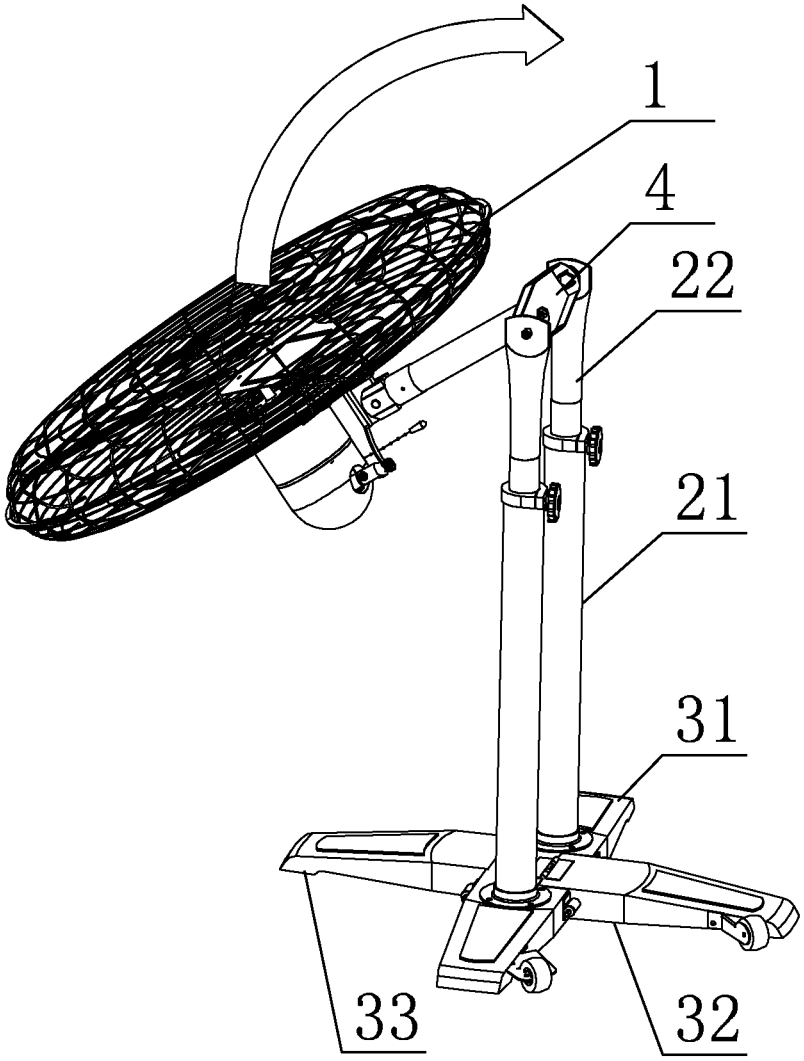
FIG. 7 is a fourth schematic view of an electric fan with its fan head turned according to Embodiment 1 of the present invention.
Figure 8:
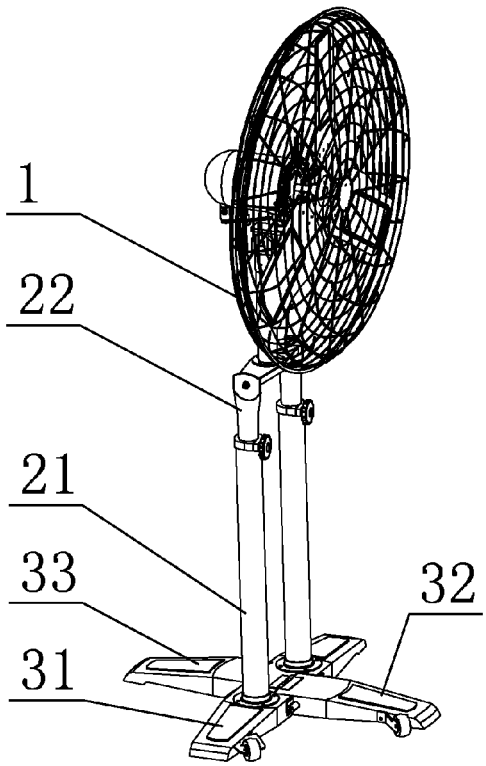
FIG. 8 is a fifth schematic view of an electric fan being arranged into a floor fan according to Embodiment 1 of the present invention.
Figure 9:
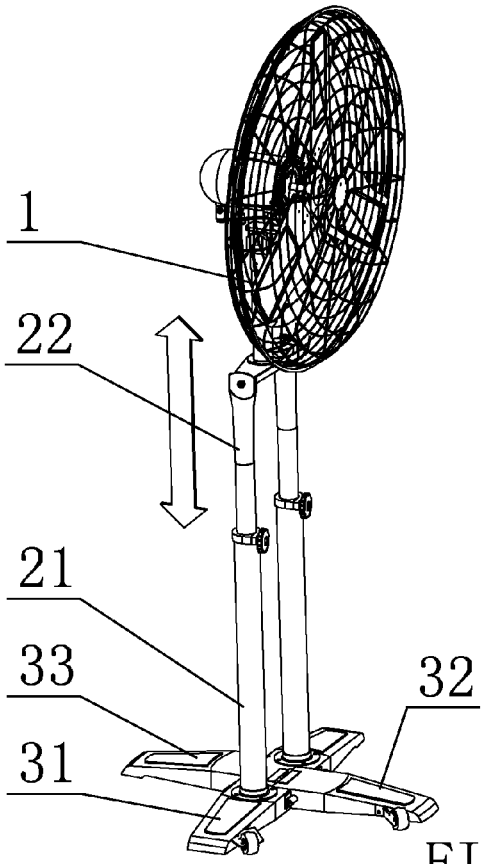
FIG. 9 is a sixth schematic view of an electric fan being adjusting its height according to Embodiment 1 of the present invention.
Figure 10:
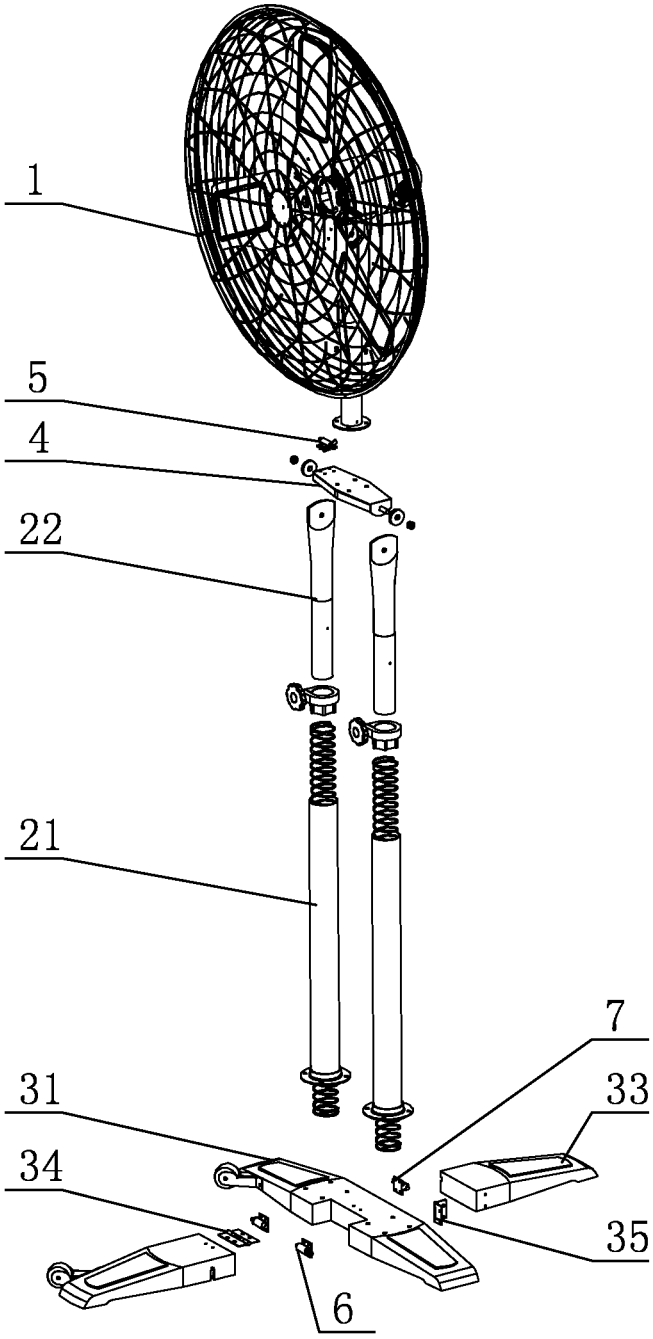
FIG. 10 is an exploded view of an electric fan according to Embodiment 1 of the present invention.
Figure 11:
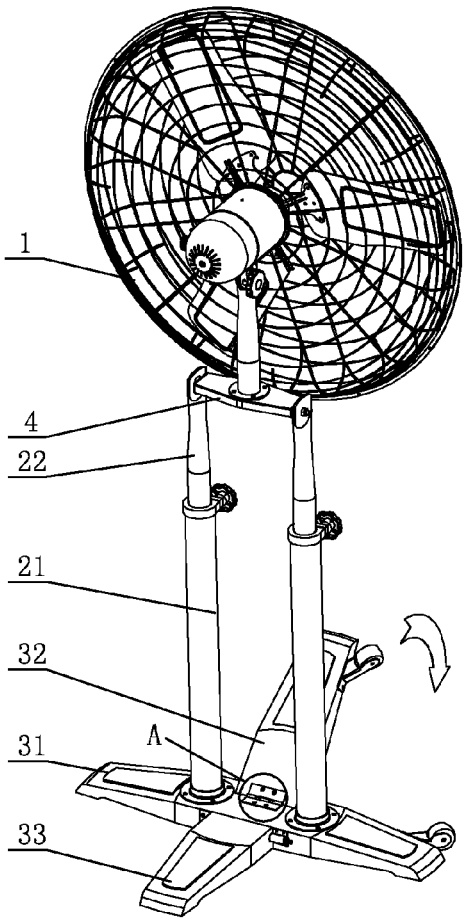
FIG. 11 is a first stereoscopic view of the back of an electric fan according to Embodiment 1 of the present invention.
Figure 12:
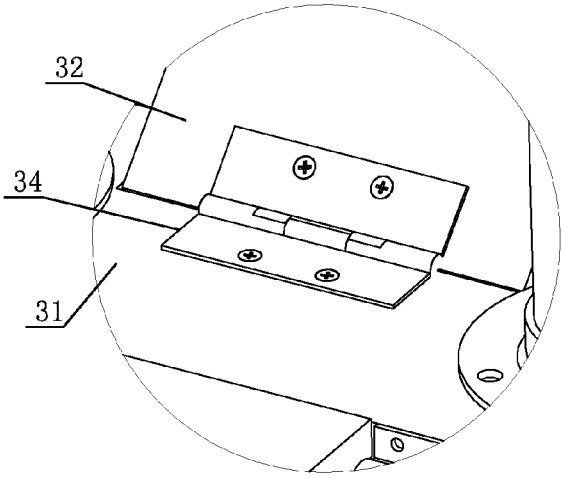
FIG. 12 is an enlarged view of part A of FIG. 11.
Figure 13:
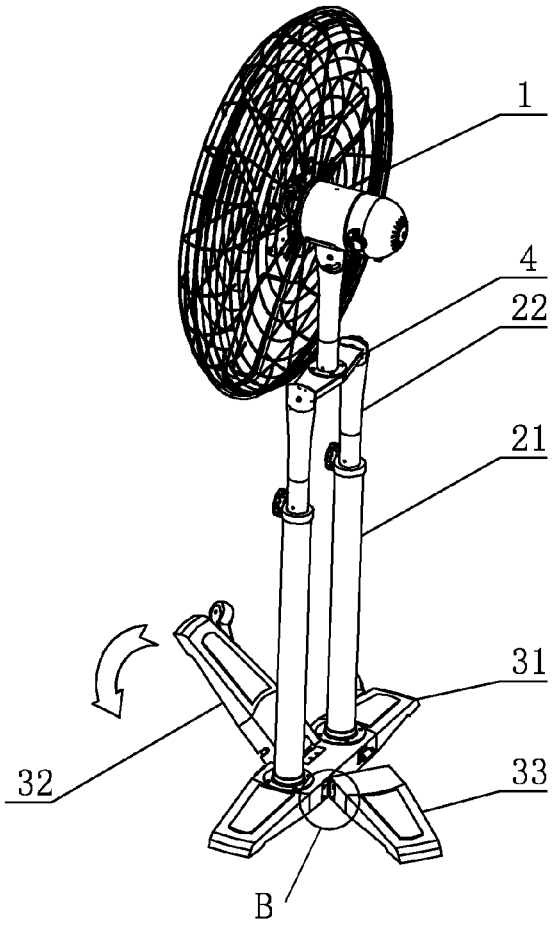
FIG. 13 is a second stereoscopic view of the back of an electric fan according to Embodiment 1 of the present invention.
Figure 14:
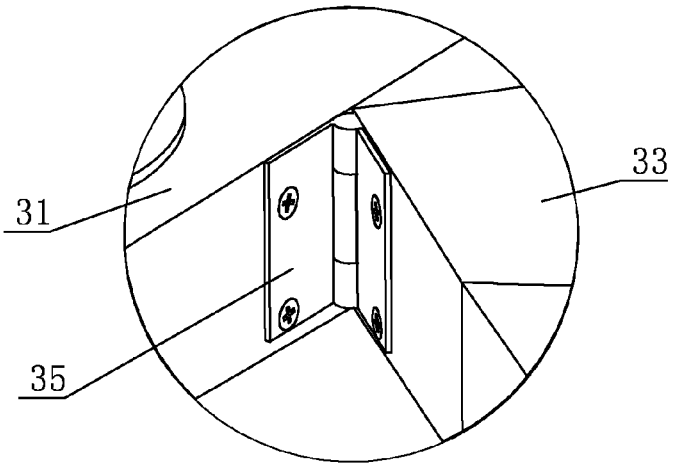
FIG. 14 is an enlarged view of part B of FIG. 13.
Figure 15:
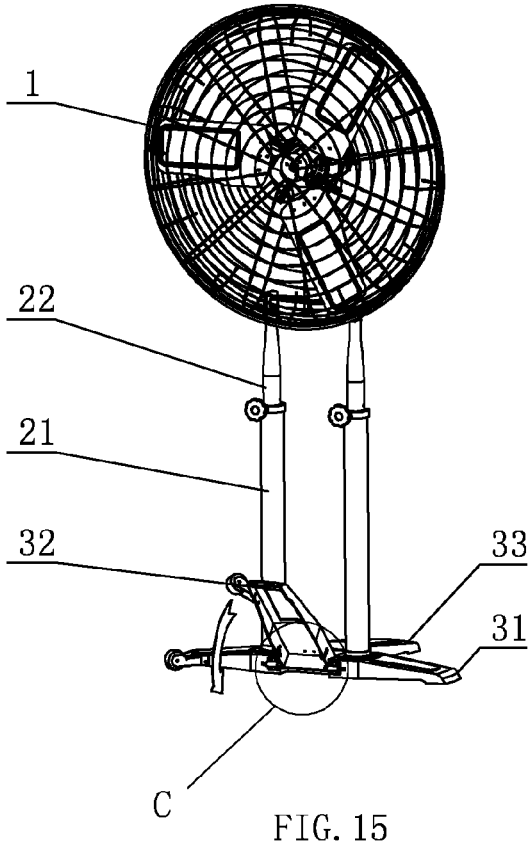
FIG. 15 is a first stereoscopic view of the front of an electric fan according to Embodiment 1 of the present invention.
Figure 16:
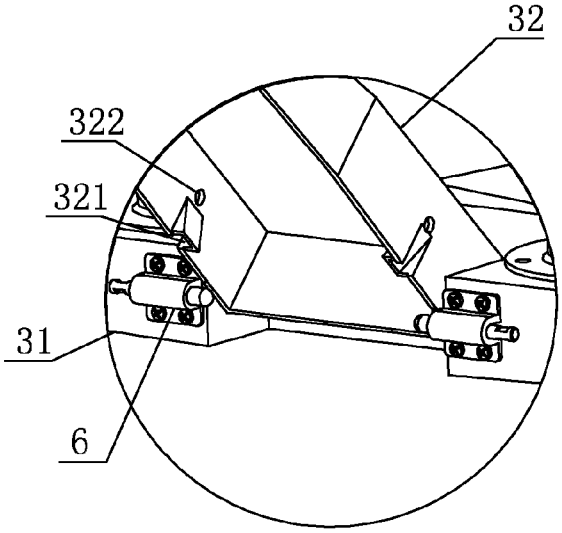
FIG. 16 is an enlarged view of part C of FIG. 15.
Figure 17:
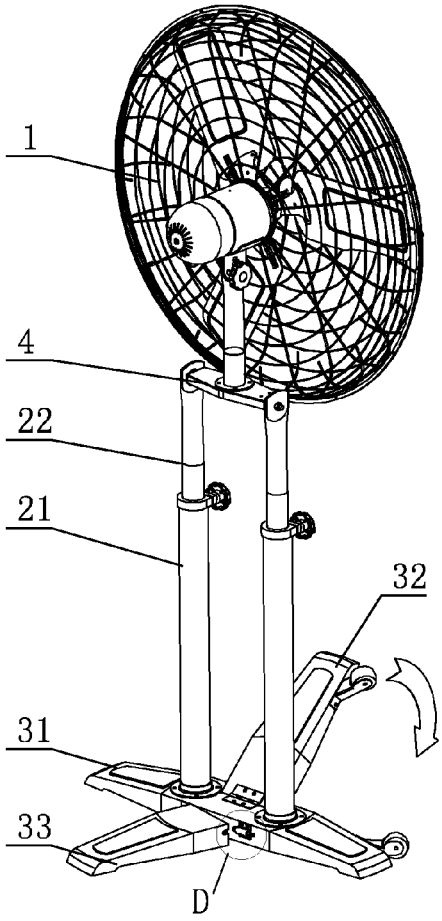
FIG. 17 is a third stereoscopic view of the back of an electric fan according to Embodiment 1 of the present invention.
Figure 18:
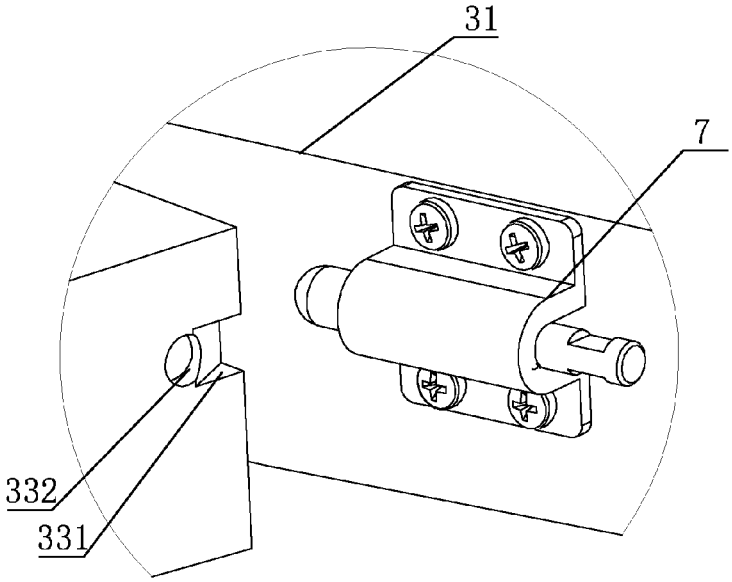
FIG. 18 is an enlarged view of part D of FIG. 17.

As shown in FIGS. 2-17, a foldable electric fan according to the present invention comprises a fan head 1, a support tube 2 and a base 3. A turnover mechanism 4 for turning the fan head 1 up or down is provided between the top of the support tube 2 and the fan head 1. Further, the base 3 according to the present invention is foldable.

The support tube 2 comprises two erect tubes 21 and two height-adjusting tubes 22 which engage with the two erect tubes respectively. The turnover mechanism 4 is connected between the top of the two height-adjusting tubes 22 and the fan head 1.

As shown in FIGS. 6, 8-11, 21, the turnover mechanism 4 comprises a connecting block 41 on the top of the two height-adjusting tubes 22, and a fan head joining tube 42 connected on the middle part of the top of the connecting block 41. An axis 411 is provided on both sides of the connecting block 41, passing through a rubber pad 43 and a hole 222 on the height-adjusting tube 22 sequentially, and then hinge connected by a nut 44.

Furthermore, an automatic position-limit and locking mechanism is provided on the top of the connecting block 41 and the height-adjusting tube 22 to limit and lock the turnover mechanism 4 for locking the fan head 4 tighter when the electric fan stands upright. The automatic position-limit and locking mechanism is a spring bolt 5 arranged on the connecting block 41, comprising a seat 51 fixed on the connecting block 41, a rod 52 through a hole in the seat 51, a compression spring 53 surrounding the rod 52, and a locating hole 221 on the top of the height-adjusting tube 22 for mating with the rod 52.

When the fan head 1 needs to be turned downwardly, pulling the rod 52 out and disengaging it from the locating hole 221, then the turnover mechanism 4 can be unlocked, and the fan head 1 can be turned up or down freely, as shown in FIGS. 6-9. When the fan head 1 of the electric fan needs to be arranged from a folded fan into a floor fan, the turnover mechanism 4 is turned so as to turn the fan head 1 upwardly until it stands upright, here the rod 52 can be moved back into the locating hole 221 of the height-adjusting tube 22 by the compression spring 53, and then the turnover mechanism 4 can be locked, preventing the hidden security troubles caused by not tightening or locking the nuts of the turnover mechanism 4.

According to this embodiment, as shown in FIGS. 7-17, the base 3 comprises a stationary base 31 paralleled with the fan head 1, a vertical moveable base 32 which can be turned upwardly, and a horizontal moveable base 33 which can be horizontally folded toward a side of the stationary base 31. The vertical moveable base 32 is articulated with the middle part of the stationary base 31 by a horizontal first door hinge assembly 34. The horizontal moveable base 33 is also articulated with the stationary base 31 by a vertical second door hinge assembly 35. Thus, the vertical moveable base 32 may be turned upwardly around the first door hinge assembly 34 which acts as a pivot, and the horizontal moveable base 33 may be turned towards the side of the stationary base 31 around the second door hinge assembly 35 which acts as a pivot. This helps to fold and store the base and reduces the space it occupied.

Figure 19:
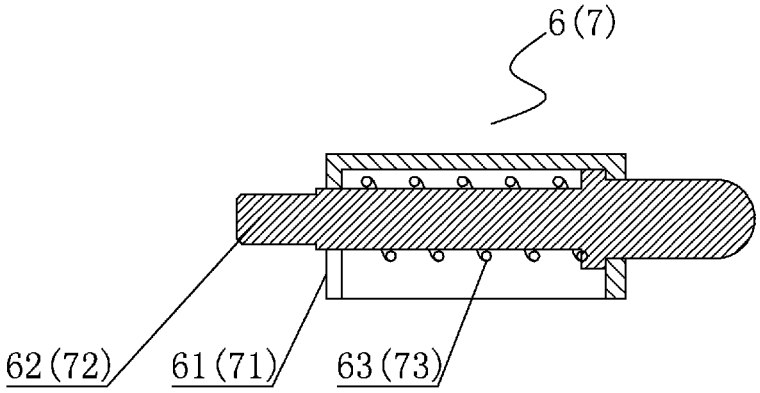
FIG. 19 is a schematic view of the internal structure of the safety bolt.
Figure 20:
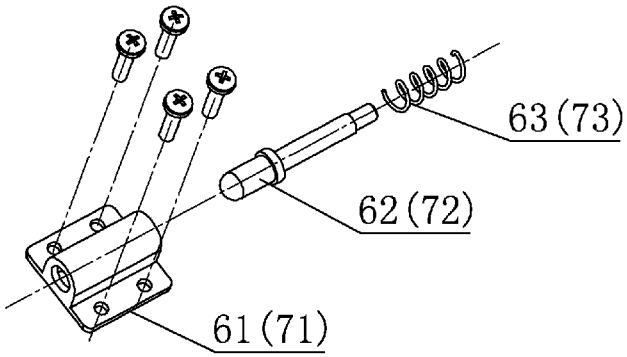
FIG. 20 is an exploded view of the safety bolt.
Figure 21:
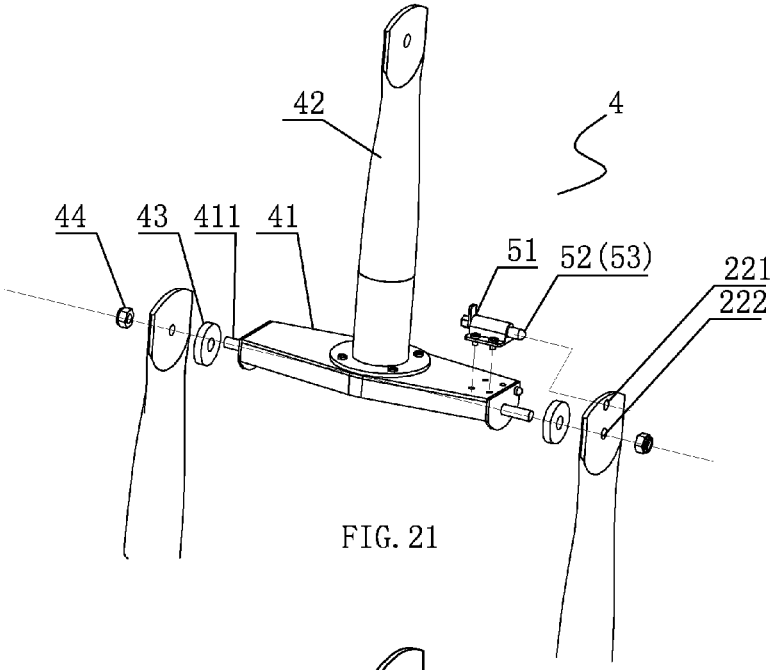
FIG. 21 is a schematic view of the turnover mechanism according to Embodiment 1 of the present invention.

As shown in FIGS. 10, 15-20, two first safety bolt assembly 6 are provided on the corresponding place of the stationary base 31 for locking and limiting the vertical moveable base 32, and a second safety bolt assembly 7 is provided for locking and limiting the horizontal moveable base 33, wherein the first safety bolt assembly 6 is fixed on a place of the stationary base 31 which corresponding to the vertical moveable base 32, and the second safety bolt assembly 7 is fixed on a place of the stationary base 31 which corresponding to the horizontal moveable base 33. The structure of the first safety bolt assembly 6, the second safety bolt assembly 7 and the spring bolt 5 are similar. As shown in FIGS. 19-20, both of them comprises a seat 61/71, a rod 62/72 through a hole in the seat 61/71, a compression spring 63/73 surrounding the rod 62/72. A first oriented groove 321 and a first bore 322 copulating with the rod 62 are provided on the bottom of the vertical moveable base 32. The first oriented groove 321 is convenient for inserting the rod 62 into the first bore 322. A second oriented groove 331 and a second bore 332 copulating with the rod 72 are provided on the bottom of the horizontal moveable base 33. The second oriented groove 331 is convenient for inserting the rod 72 into the second bore 332.

The locking and limiting principle of two first safety bolt assembly 6 and the second safety bolt assembly 7 are completely the same with the spring bolt 5 of the turnover mechanism 4, which may not be described herein.

Furthermore, according to the present invention, two wheels 9 are provided in the front of the bottom of the base 3, so the electric fan is easy to move whenever it needs to.

Embodiment 2

Figure 22:
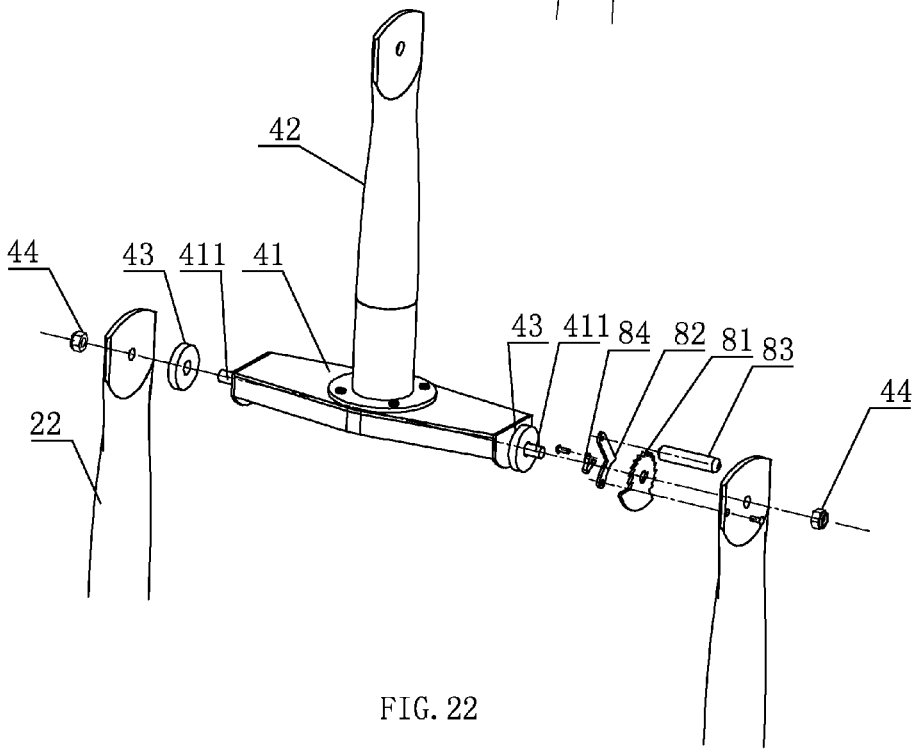
FIG. 22 is a schematic view of the turnover mechanism according to Embodiment 2 of the present invention.
Figure 23:
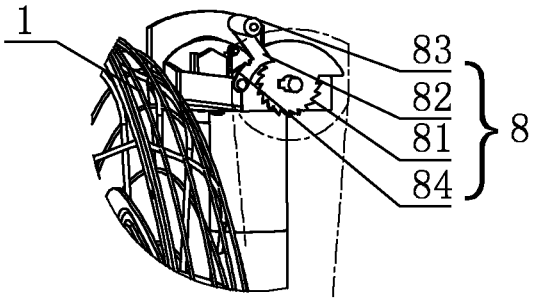
FIG. 23 is a first schematic view of the pawl ratchet assembly according to Embodiment 2 of the present invention, showing the engagement of the ratchet and the pawl when the fan is folded.
Figure 24:
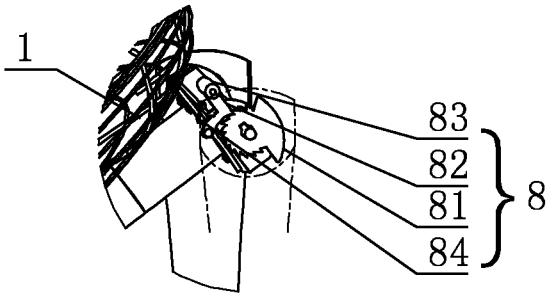
FIG. 24 is a second schematic view of the pawl ratchet assembly according to Embodiment 2 of the present invention, showing the engagement of the ratchet and the pawl when the fan is turning.
Figure 25:
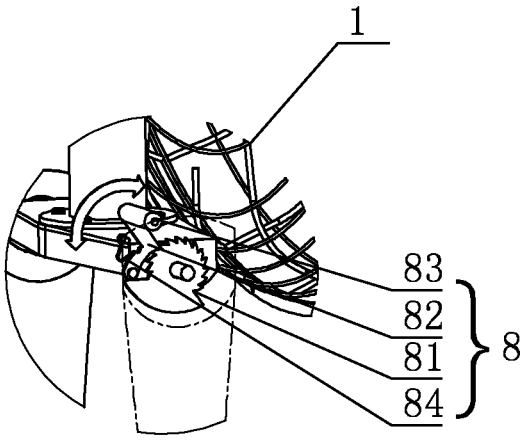
FIG. 25 is a third schematic view of the pawl ratchet assembly according to Embodiment 2 of the present invention, showing the engagement of the ratchet and the pawl when the fan is a floor fan.

The structure according to this embodiment and Embodiment 1 are almost the same, but the structure of the automatic position-limit and locking mechanism of the turnover mechanism 4 in this embodiment is different. As shown in FIG. 22, the automatic position-limit and locking mechanism is a pawl ratchet assembly 8 installed between the end of the connecting block 41 and the height-adjusting tube 22. A pivot 411 on the end of the connecting block 41 passes through a center hole of the ratchet 81 and a mounting hole on the top of the height-adjusting tube 22 sequentially, and then connected with a nut 44. The pawl 82 engaging with the ratchet 81 is articulated with the inside of the top of the height-adjusting tube 22. A rotatable handle 83 is fixed joint on the outside of the pawl 82. As shown in FIGS. 23-25, a V-shape spring 84 is tightened on the inside of the top of the height-adjusting tube 22 for providing the elastic resilience of the pawl 82.

As shown in FIG. 23, when the fan head 1 is folded-up, the pawl 82 can be engaged and limited by the ratchet 81, thus the fan head 1 can be turned upwardly only. As shown in FIG. 24, when the fan head 1 is turned on betweenness, the fan head 1 can not be turned downwardly and can be fixed on any arbitrary angle because the ratchet 81 is fastened by the pawl 82. As shown in FIG. 25, when the fan head 1 is being arranged into a floor fan, the ratchet 81 can be turned and locked by the automatic position-limit and locking mechanism, the pawl 82 can be locked on the present state for a better effect of limiting and locking. Moreover, when the fan head 1 need to be folded-up, the rotatable handle 83 may be rotated, then the pawl 82 is disengaged with the ratchet 81, and the fan head 1 can be turned and arranged into a folded fan.

Embodiment 3

Figure 26:
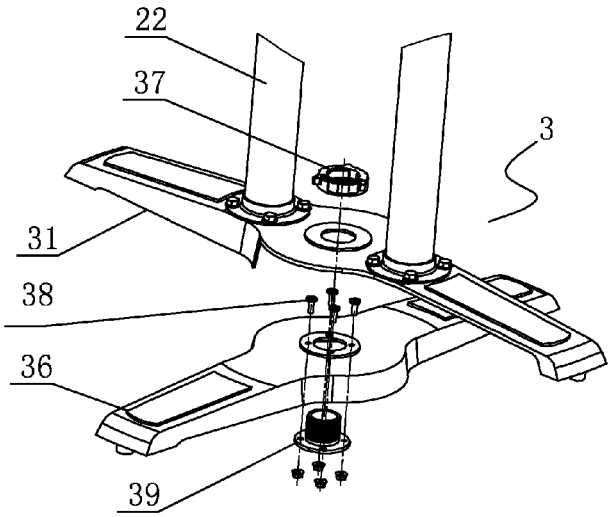
FIG. 26 is an exploded view of the base according to Embodiment 3 of the present invention.

The difference between this embodiment and Embodiment 1 is shown in FIG. 26, the base 3 comprises a stationary base 31 paralleled with the fan head 1, and a rotatable base 36 under the stationary base 31. The rotatable base 36 can be engaged with the bottom of the stationary base 31. The rotatable base 36 is detachable joint with the stationary base 31 by a lock nut 37, a fastening bolt 38 and a lock screw 39.

Figure 27:
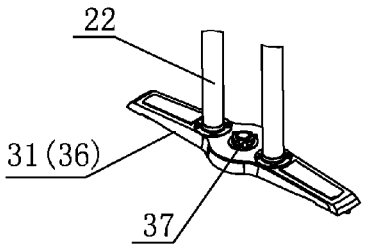
FIG. 27 is an assembly view of the base according to Embodiment 3 of the present invention.
Figure 28:
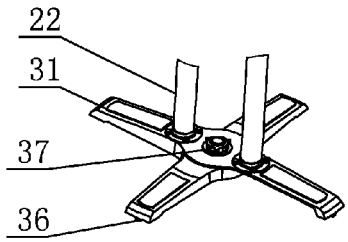
FIG. 28 is a schematic view of the base in use according to Embodiment 3 of the present invention.

As shown in FIGS. 26-27, when the electric fan needs to be folded, the lock nut 37, the lock screw 39 can be loosen, and the fastening bolt 38 can be taken off, and the rotatable base 36 can be rotated and engaged with the lower part of the stationary base 31. As shown in FIG. 28, when the electric fan needs to be arranged into a floor fan or a desk fan, the rotatable base 36 and the stationary base 31 cross and tighten with each other, insuring the stability of the electric fan.

Embodiment 4

The structure according to this embodiment and Embodiment 3 are almost the same. The difference is that only a fastening bolt 38 is provided on the center of the stationary base 31 and the rotatable base 36 for engagement in this embodiment.

Figure 29:
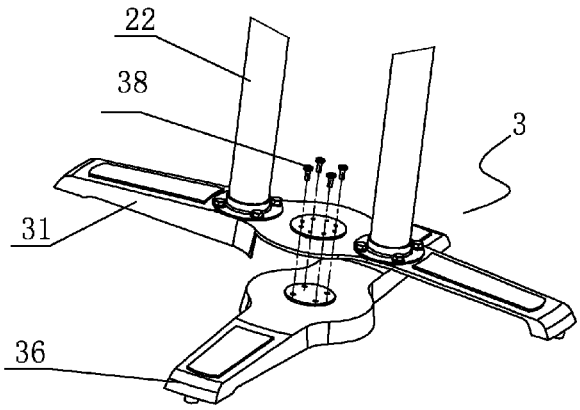
FIG. 29 is an exploded view of the base according to Embodiment 4 of the present invention.
Figure 30:
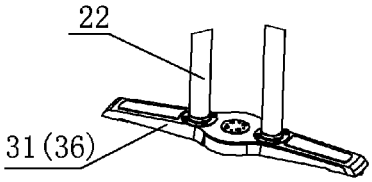
FIG. 30 is an assembly view of the base according to Embodiment 4 of the present invention.
Figure 31:
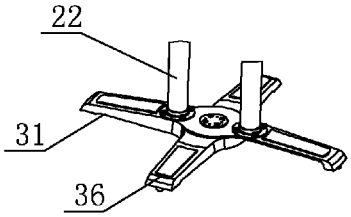
FIG. 31 is a schematic view of the base in use according to Embodiment 4 of the present invention.

As shown in FIGS. 29-30, when the electric fan needs to be folded, the fastening bolt 38 can be loosen, and the rotatable base 36 can be engaged with the lower part of the stationary base 31. As shown in FIG. 31, when the electric fan needs to be arranged into a floor fan or a desk fan, the rotatable base 36 and the stationary base 31 cross and tighten with each other, insuring the stability of the electric fan.

Furthermore, the height-adjusting tube 22 according to the present invention can be demounted, i.e. the turnover mechanism 4 is directly arranged on the erect tubes 21.

The present invention is not limited to the above embodiments. If various modification or variations to the present invention do not depart from the spirit and scope of the present invention, the present invention also intends to contain the various modifications and variations if they fall within the scope of claims of the present invention and equivalent technologies.

What is claimed is:

1. A foldable electric fan, comprising:

a fan head;

a support tube;

a base; and a turnover mechanism provided between the support tube and the fan head for turning the fan head up or down;

wherein said support tube comprises at least two erect tubes and at least two height-adjusting tubes engaging with the at least two erect tubes respectively;

wherein said turnover mechanism is connected between a top of said at least two height-adjusting tubes and the fan head;

wherein said turnover mechanism comprises a connecting block connected on the top of the at least two height-adjusting tubes and a fan head joining tube connected on a middle part of the top of said connecting block, wherein a plurality of axes are provided on both sides of said connecting block respectively, and each of the plurality of axes through a hole on the height-adjusting tube and then hinge connected with a nut;

wherein an automatic position-limit and locking mechanism is provided on the top of the connecting block and the height-adjusting tube to limit and lock said turnover mechanism wherein said automatic position-limit and locking mechanism is a pawl ratchet assembly installed between an end of the connecting block and the height-adjusting tube, the pawl ratchet assembly including:

a pivot on the end of the connecting block passing through a center hole of the ratchet; and a mounting hole on the top of the height-adjusting tube sequentially, and then connects with a nut, wherein the pawl engaging with the ratchet is configured between the end of the connecting block and the ratchet;

a rotatable handle is fixedly jointed on the outside of the pawl; and a V-shape spring providing the elastic resilience of the pawl is configured between the connecting block and the pawl.

2. The foldable electric fan according to claim 1, wherein the base comprises:

a stationary base paralleled with the fan head;

a horizontal moveable base configured to be turned upwards; and a vertical moveable base configured to be horizontally folded towards a side of said stationary base;

wherein said horizontal moveable base is articulated with the middle part of the stationary base by a horizontal first door hinge assembly, wherein said vertical moveable base is also articulated with the stationary base by a vertical second door hinge assembly, wherein a plurality of safety bolts are provided on a corresponding place of the stationary base to fasten the horizontal moveable base and the vertical moveable base.

3. The foldable electric fan according to claim 1, wherein the base comprises:

a stationary base paralleled with the fan head; and a rotatable base under the stationary base, wherein said rotatable base is configured to be folded to said stationary base, wherein said rotatable base is detachably jointed with said stationary base by a lock nut, a fastening bolt and a lock screw.

4. The foldable electric fan according to claim 1, wherein the base comprises:

a stationary base paralleled with the fan head; and a rotatable base under the stationary base;

wherein said rotatable base is configured to be folded to said stationary base, and wherein said rotatable base is detachably jointed with said stationary base by a fastening bolt.

5. A foldable electric fan, comprising:

a fan head;

a support tube;

a base; and a turnover mechanism provided between the support tube and the fan head for turning the fan head up or down;

wherein the base comprises a stationary base paralleled with the fan head and a rotatable base under the stationary base;

wherein said rotatable base is configured to be folded to said stationary base;

wherein said rotatable base is detachably jointed with said stationary base by a lock nut, a fastening bolt and a lock screw.

6. A foldable electric fan, comprising:

a fan head;

a support tube;

a base; and a turnover mechanism provided between the support tube and the fan head for turning the fan head up or down;

wherein the base comprises a stationary base paralleled with the fan head, a horizontal moveable base configured to be turned upwards, and a vertical moveable base configured to be horizontally folded towards a side of said stationary base;

wherein said horizontal moveable base is articulated with the middle part of the stationary base by a horizontal first door hinge assembly;

wherein said vertical moveable base is also articulated with the stationary base by a vertical second door hinge assembly;

wherein a plurality of safety bolts are provided on a corresponding place of the stationary base to fasten the horizontal moveable base and the vertical moveable base.

* * * * *